US005590430A

United States Patent [19]

Sereboff

[11] Patent Number: 5,590,430

[45] **Date of Patent: *Jan. 7, 1997**

[54] GEL FILLED DEFORMABLE CUSHION AND COMPOSITION CONTAINED THEREIN

[76] Inventor: Joel L. Sereboff, 204 E. Joppa Rd., Penthouse Suite 10, Towson, Md. 21286

[ * ] Notice: The term of this patent shall not extend beyond the expiration date of Pat. No. 5,475,882.

[21] Appl. No.: 466,785

[22] Filed: Jun. 6, 1995

Related U.S. Application Data

[63] Continuation-in-part of Ser. No. 136,273, Oct. 15, 1993, Pat. No. 5,475,882.

[51] Int. Cl.[6] ..... A47C 16/00

[52] U.S. Cl. ..... 5/655.5; 5/702; 5/676; 5/909; 5/911

[58] Field of Search ..... 5/499, 450, 654, 5/644, 909, 911, 702, 655.4, 655.5, 676

[56] References Cited

U.S. PATENT DOCUMENTS

| | | | |
|---|---|---|---|
| 3,748,669 | 7/1973 | Warner . | |
| 3,968,530 | 7/1976 | Dyson . | |
| 3,986,213 | 10/1976 | Lynch . | |
| 4,380,569 | 4/1983 | Shaw | 428/283 |
| 4,456,642 | 6/1984 | Burgdorfer et al. | 5/909 X |
| 4,588,229 | 5/1986 | Jay . | |
| 4,728,551 | 3/1988 | Jay . | |
| 4,761,011 | 8/1988 | Sereboff . | |
| 5,093,138 | 3/1992 | Drew et al. . | |
| 5,100,712 | 3/1992 | Drew et al. . | |
| 5,113,540 | 5/1992 | Sereboff . | |
| 5,141,489 | 8/1992 | Sereboff . | |
| 5,303,977 | 4/1994 | Sereboff . | |
| 5,475,882 | 12/1995 | Sereboff | 5/450 |

*Primary Examiner*—Michael F. Trettel
*Attorney, Agent, or Firm*—Eckert Seamans Cherin & Mellott

[57] ABSTRACT

This invention provides for an ultra low density gel filled deformable cushion (10) which includes a fluid impervious flexible enclosure (12) forming an internal chamber (14). Contained within the internal chamber (14) is a padding fluid composition (16) and a plurality of particulates (18) dispersed within the padding fluid composition (16). The particulates (18) are spherically contoured and have a density which is less than the density of the padding fluid composition (16) for increasing resiliency, deformability and memory of the overall composition within the cushion (10). The spherically contoured particulates are selected from the group consisting of plastic composition microspheres, ceramic composition microspheres and combinations thereof, thereby exhibiting a bounce effect in the gel.

18 Claims, 1 Drawing Sheet

GEL FILLED DEFORMABLE CUSHION AND COMPOSITION CONTAINED THEREIN

BACKGROUND OF THE INVENTION

This is a continuation-in-part of U.S. patent application Ser. No. 08/136,273, filed Oct. 15, 1993, now U.S. Pat. No. 5,475,882.

FIELD OF THE INVENTION

This invention directs itself to a gel filled deformable cushion and gel composition contained therein. Of great importance is that the invention relates to an ultra low density gel filled cushion which provides the user with an extremely low weight cushion which may be easily transported and/or manipulated by the user. In particular, this invention pertains to a deformable low density gel composition for use in a system undergoing force loading. This invention directs itself to a gel composition for insert within a flexible cushion where the gel composition is formed of a plasticizer composition having a plurality of particulates dispersed therein. Still further, this invention pertains to a low density gel composition that utilizes alkyl phthalate compositions as a plasticizer. More in particular, this invention relates to a deformable low density gel composition using a padding fluid composition in combination with substantially microspherically contoured particulates comprised of plastic, ceramic and combinations thereof dispersed therein to form a thixotropic type composition where a high viscosity is maintained under low shear conditions and a lowered viscosity under high shear conditions. Still further, this invention directs itself to a deformable ultra low density gel composition including both a padding fluid composition comprising carbopol and water/glycerin, vegetable oil and emulsions. Additionally, this invention relates to a deformable low density gel composition including a plurality of microsphere particulates dispersed within a padding fluid composition where the microsphere particulates have a diameter of about 100 to 400 microns. This plurality of particulates has a density less than the density of the padding fluid. Further, this invention directs itself to a fluid cushion which is deformable upon contiguous contact by a user's body and includes a deformable gel like composition therein which has a memory for reinstituting the original shape of the outer contour of the fluid cushion when relieved of a user's force loading. Additionally, this invention relates to a fluid cushion which includes a contained composition which is less flammable than commonly used mineral oils and which is also of low weight, decreasing shipping weight costs.

DESCRIPTION OF THE PRIOR ART

Fluid filled cushions are known in the art. However, some prior art types of liquid filled or deformable cushions use water as a prime constituent of the fluid compositions, as described in prior art U.S. Pat. No. 5,100,712. However, the use of such water based types of fill compositions for cushions provides a system which is inordinately high in weight and increases the cost of transportability. Additionally, such prior art water-like systems have low deformation rates due to the non-compressibility of the water based liquids contained therein.

Other prior art systems and compositions for fluid cushions include mineral oil or alcohol liquids as provided in U.S. Pat. No. 5,093,138. However, such prior art systems and compositions suffer from the same type of disadvantages as described for the water based fluid cushion fillings. Still further, such prior art systems provide a system which is more flammable than the subject invention concept and may provide disadvantages as to safety considerations in the advent of leakage of the internally contained compositions.

Other prior art systems do not provide the ultra low density of the present system, which results in increased difficulties in their overall use, nor do they provide for an interactive combination of ceramic and plastic composition microspheres. They also have a problem with the freezing of the water based system when the prior art systems are in an unheated area.

SUMMARY OF THE INVENTION

This invention provides for a deformable ultra low density gel composition which includes a plasticizer composition having a first predetermined density value. Additionally, a plurality of particulates are dispersed within the plasticizer composition where the particulates are generally spherical in contour and include a second predetermined density which is less than the density of the plasticizer composition.

This invention also provides for a deformable ultra low density gel composition which includes a padding fluid composition having a first predetermined density value. Additionally, a plurality of particulates selected from the group consisting of plastic composition microspheres, ceramic composition microspheres and combinations thereof are dispersed within the padding fluid composition where the particulates are generally spherical in contour and include a second predetermined density which is less than the density of the fluid padding composition. The gel composition has about 60–80% by weight of said padding fluid to about 20–40% by weight of said plurality of particulates.

DESCRIPTION OF THE PREFERRED EMBODIMENTS

Figure 1:
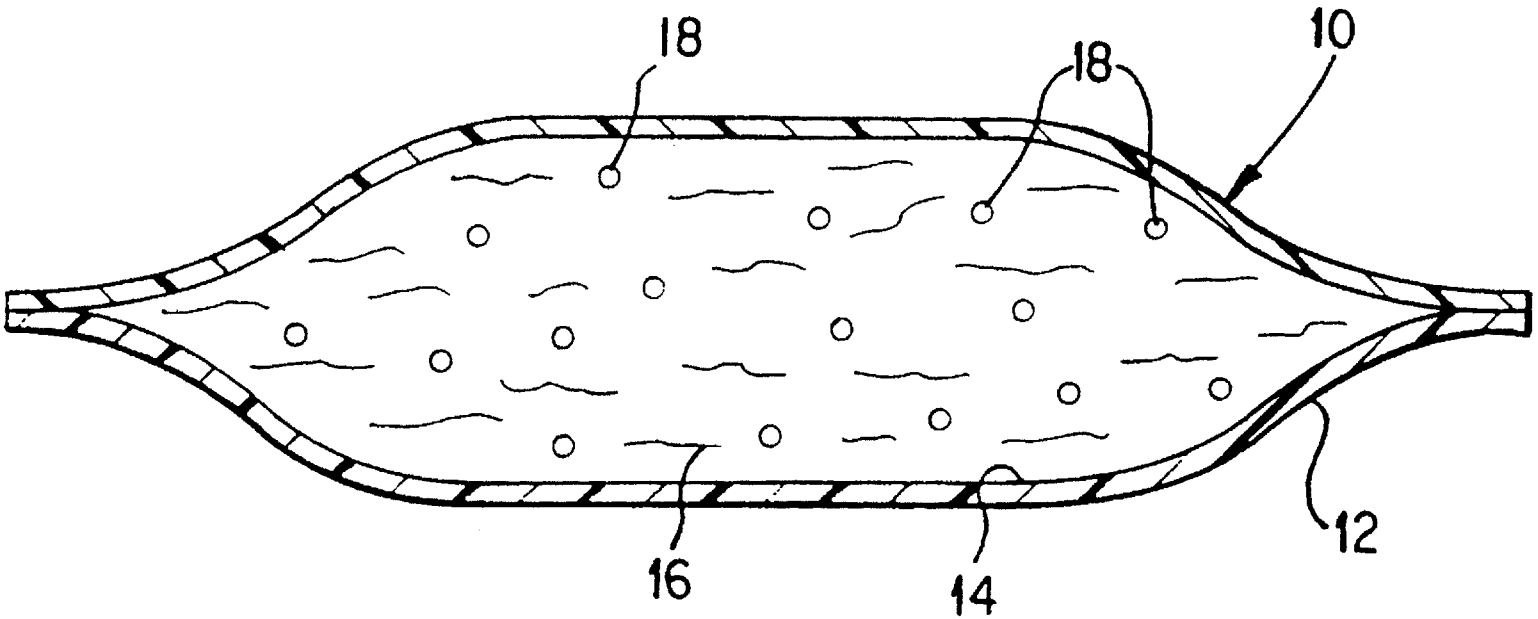
FIG. 1 shows in cross-section a gel filled deformable cushion having contained therein a gel composition with dispersed spherical particulates of plastic composition microspheres, ceramic composition microspheres, and combinations thereof.

Referring now to the Figure, there is shown a gel filled deformable cushion 10 having a fluid impervious flexible enclosure 12 forming a closed internal chamber 14.

In overall concept, cushion 10 is used for contiguous interface with a user's body to disperse force loading over a wider area to lower stress applied and increase the comfort level of the user. Additionally, and in combination with the aforementioned concept, cushion 10 must be formed in a manner to provide an ultra low density system resulting in an optimized low weight cushion 10. Cushion 10 must be adaptable to a wide range of external environmental conditions since it may be used in any environment chosen by the ultimate user.

The development of the subject combination of cushion 10 and composition contained therein has taken into account a wide variety of concatenating parameters which include optimization of weight, safety in the form of composition flammability, deformability and flexibility, as well as memory of the cushion 10.

Internal chamber 14 is substantially filled with gel composition 16 having dispersed therein a plurality of substantially spherically contoured particulates 18 with the important physical parameter criteria that particulates 18 have a lower density than gel composition 16. The spherical particulates are selected from a group consisting of plastic composition microspheres, ceramic composition microspheres and combinations thereof.

The combined gel composition 16 and spherically contoured particulates 18 are formed into a gel like overall composition which is maintained within the fluid-tight enclosure 12. The gel like composition, as herein described in the following paragraphs, is particularly adapted for compression by portions of a user's body.

Deformable cushion 10 disperses the forces applied by a user's body over a wide area to lower stress and to disperse the applied forces over a wider area of the body, thus lowering the force loading per unit area in the areas of contact between the user's body and cushion 10. There are certain areas of the human body which when contacting the cushion 10 are somewhat like point loading areas such as bony areas of the human body. Particularly, although not directed specifically to this anatomical feature, the ischium of a person is one of three parts of the hip bone which joins the ilium and the pubis to form the acetabulum. The ischium includes the dorsal portion of the hip bone and is divided into the body of the ischium which forms two-fifths of the acetabulum and the ramus which joins the inferior ramus of the pubis. The spine of the ischium provides attachment for a multiplicity of muscles such as the gemellus superior, the coccygeus, and the levitator ani. Illustrative of the point loading are the ischial spines, which are relatively sharp bony projections, into the pelvic outlet from the ischial bones that form the lower border of the pelvis. Particularly, it is of importance that these sharp bony projections when in contiguous contact with cushion 10 create forces which are dispersed over a wider area to optimize comfort of the person interfacing with cushion 10.

The particular cushion 10 and composition contained therein as herein described have been conceived for the specific purpose of optimizing the comfort of the user. Cushion 10 may be used as a seat member for a chair, a back rest, a cervical brace or even inserted within a fluid containment device such as a bathtub for positional stabilization of a person to increase the comfort level of the user. The ultra low density and resulting low weight of cushion 10 allows the user to transport cushion 10 from one environment to another in a simple manner.

The particular gel composition as herein described has certain characteristics which are particularly directed to optimization of comfort and usage by a user. Of importance is the fact that any fluid containment device which must be transported from one area to another should have a low weight in order to allow transportability of the overall cushion system by a user. Liquids such as water have relatively high densities which increase the overall weight of cushion 10. Thus, compositions having a relatively high density could not be used as the gel composition of the subject invention system. Therefore, the final gel composition for cushion 10 had a basic criteria of having a relatively low density. Additionally, in order to provide this low density type system it was found that both a gel composition in combination with particulates have a great optimizing effect with regard to weight as well as to deformation characteristics, or rheology, as will be further described. Of importance is the fact that the overall composition have a deformable contour in order to allow contiguous mating with differing contours of a user's body which contact the cushion 10. Further, the overall gel composition must include a memory which allows the outer contour or enclosure 12 to eventually return to an initial shape subsequent to being force loaded. However, the composition must be thixotropic to reduce pressure while yielding to shear from the body. The rheology of the composition herein described is of the utmost importance to the comfort of the user.

The deformable low density gel composition as herein will be described is particularly adaptable to fluid cushions such as those shown and described in U.S. Pat. No. 5,113,540 and U.S. Pat. No. 5,141,489 for a wrist support and U.S. Pat. No. 5,356,099 for a cervical brace, having common inventorship with the subject composition system. Initially, water was used as the liquid composition to fill cushion 10; however, it was found that such provided an unacceptable high weight which was impractical for transportability purposes an unacceptable reaction theology because rebound pressure of the body.

Gel compositions were chosen as the composition within cushion 10. However, such was not found to have sufficient resiliency memory or appropriate rheology for use as a body engaging or interfacing cushion while at the same time substantially reducing pressure. Surprisingly, it was found that by inserting a quantity of spherically contoured particulates of plastic composition, ceramic composition and combinations thereof within the gel composition of a preferred size, that the resiliency of the overall mixture increased dramatically over the mere use of the gel composition. Additionally, when particulates were used which had a density greater than the density of the gel composition, the resiliency and memory of the overall cushion 10 was once again diminished. It was thus discovered that the resiliency of the overall cushion 10 increased as a function of the relative densities of the gel composition and the particulates dispersed therein. Although it is not known the exact process by which the combined qualities of pressure reduction and resiliency are increased when the density of the particulates is less than the gel composition, it is believed that the particulates actually deform under loading, and when relieved of the loading provide for a restoring type force to the gel composition. Additionally, it is believed that the lower density of the particulates allows the particulates to maintain a more homogeneous mixture with the gel composition over an extended period of time. It was also found that a combination of the plastic composition particulates and ceramic composition particulates together gave a "bounce effect" to the gel composition.

In one embodiment, a plasticizer was used as the padding fluid in the gel composition. Plasticizers are generally small organic molecules that act as lubricants between chains and are generally added to plastics to keep them from becoming brittle at room temperatures. Such plasticizers as may be useful in the subject composition must be relatively nonvolatile liquids which are blended with polymers to alter their properties by intrusion between the polymer chains. The particular plasticizer used in the subject composition is generally colorless and was chosen from the phthalate ester chemical family. In particular, this is an alkyl phthalate, and further in particular diisononyl phthalate was chosen as the plasticizer which provided for the appropriate physical parameters necessary. The plasticizer composition generally has a specific gravity approximating 0.97 with a density range approximating 0.8–1.2 gm/cc. Different batches of the plasticizer compositions depicted a range of densities; however, final plasticizers used in the subject composition approximated 1.0 gm/co. The particular plasticizer composition successfully used in the subject cushion 10 is 1,2 benzenedicarboxylic acid, di-C8-10 br alkyl ester. This is sold under the product name of JAYFLEX DINP by Exxon Chemical Americas, a division of Exxon Chemical Company having a business address in Houston, Tex.

In addition to the physical parameters necessary, the plasticizer composition was chosen for the fact that it will be used in a wide range of environments by a user, and in the event that such egresses from the enclosure 12, such must have minimal toxicity with substantially no inhalation hazard at ambient temperatures and if it comes into skin contact such must exhibit a low order of toxicity.

Normally, the plasticizer composition chosen is only inflammable upon heating to temperatures at or above the flash point which is approximately 415° F.

Thus, one of the important points for the particular plasticizer composition being used is that the overall composition may come in contact with the user with minimal toxicity and may be used over a wide variety of environmental conditions with minimal hazard to the user under normal operating conditions.

Another embodiment of the present invention uses a low density "padding fluid" 16 as the composition within cushion 10. Again, central to gel-like overall composition 16 which is maintained within the fluid tight enclosure 12 is the unique plastic composition microspheres, ceramic composition microspheres or a combination of plastic and ceramic microspheres 18 leading to a "bounce effect".

TABLE

Microsphere-filled fluid: Formula reference K, 11/8/94 (Laboratory batch)

| Ingredient | Wt., lbs. | D, gm/cc | V, gal. | Wt. % | V % |
|---|---|---|---|---|---|
| Oil [1] | 1300.0 | 0.924 | 169.3 | 76.42 | 51.0 |
| Preservative [2] | 1.9 | 1.000 | 0.2 | 0.11 | 0.1 |
| blend | | | | | |
| Fumed Si [3] | 80.0 | 2.400 | 4.0 | 4.70 | 1.2 |
| disperse well, high shear, then degas | | | | | |
| Microspheres [4] | | | | | |
| PM 6545 | 19.2 | 0.021 | 109.6 | 1.13 | 33.1 |
| EXTENDOSPHERES | 300.0 | 0.740 | 48.6 | 17.64 | 14.7 |
| CG | | | | | |
| blend to smooth mixture, LOW shear and LOW speed | | | | | |
| Totals: | 1701.1 | | 331.7 | 100.00 | 100.0 |
| Calculated formulation density: | 0.616 gm/cc | | | | |
| ACTUAL measurements | | | | | |
| Viscosity, 25° C. [5] | 1,500,000 cps at 0.5 rpm<br>147,000 cps at 5.0 rpm | | | | |
| Density, "apparent" [6] | 5.12 lbs. per gal. | | | 0.614 gm/cc | |

EXAMPLE I

Referring to the table hereinabove, soybean oil, sunflower oil, pine oil or linseed oil is blended with a preservative Henkel's COVI-OX T-70 with a laboratory dispersator (or mixer on a larger scale) until smooth. Fumed silica is dispersed well using high shear and then degassed by placing gel in a vacuum mixer and agitating to release bubbles. The ceramic and plastic microspheres given in the table above are then added and the low density "padding fluid" is then blended to a smooth mixture with low shear and low speed. Depending on batch size, this is done by a planatary mixer that is used at less than 100 rpm. The viscosity at 25° C. is about 1,500,000 cps at 0.5 rpm and about 147,000 cps at 5.0 rpm using a Brookfield model HBT viscometer, TB spindle and the "apparent" density using a Gardner weight per gallon cup, 8.32 mL volume is 5.12 lbs. per gallon or about 0.614 gm/co. This is measured by standard laboratory procedure.

Another embodiment of the present invention uses a padding fluid of water/glycerin with Carbopol® EZ-1 (16) as the composition within cushion 10. Carbopol is much less dense than fumed silica as a thickener and this contributes to the ultra low density of the mixture. Again, central to the gel-like overall composition 16 which is maintained within the fluid fight enclosure 12 are the unique plastic composition microspheres, ceramic composition microspheres or a combination of the plastic and ceramic microspheres leading to a "bounce effect" and producing a more effective comfort rheology. It has been found that Carbopol® EZ-1 enhances the "bounce effect" of the ceramic and plastic microsphere combination. Carbopol® has superior dispersing properties and is superior as a wetting agent even in an oil phase. Once the applied stress exceeds critical yields, it stops the critical yields in moving past each other and bulk gel begins to flow.

EXAMPLE II

Padding Fluid with Carbopol® EZ-1

The ratio of glycerin to water can be anywhere from 0 to 100 parts by weight of both glycerin and water. Preferably, it is 70 parts by weight of glycerin to 30 parts by weight of water. This is an ideal ratio to prevent freezing and works as a natural antifreeze. Approximately two parts by weight Carbopol® EZ-1 powder is added for thickening and suspending ingredients in water. Carbopol® EZ-1 resin is a cross-linked polyacrylic acid thickener and can be easily dispersed in water. To the 700 lbs glycerin, mix in for about 5 minutes about 0.1 to 0.5 weight percent of Carbopol® EZ-1. Add aleionized or distilled water, about 300 lbs and blend for about 10 to 20 minutes, preferably 15 minutes, at low speed. Neutralize by raising the pH to about 6 to 8, preferably 7. The bases can be selected from the group consisting of 28% ammonium hydroxide, 18% sodium hydroxide, morpholine and triethanolamine. For 28% ammonium hydroxide you need about 1.0 lb base/lb Carbopol® EZ-1, for 18% sodium hydroxide, about 2.0 lb/base/lb Carbopol® EZ-1, for triethanolamine, about 1.5 lb of base is needed for 1.51 lb Carbopol® EZ-1. This gives a thick gel and the thick gel is then degassed with a vacuum mixer and agitation to release bubbles. The plastic and ceramic microspheres are then added. Add 2 parts PM 6545 plastic microspheres at a range of 0 volume percent to 60 volume percent. Add 60 to 0 volume percent extendospheres which are about 200 parts ceramic. Add more Carbopol® EZ-1 to thicken or add PM and CG spheres to lighten gel. Blend on low speed/low shear for about 5 minutes to smooth the mixture. The "apparent" density using a Gardner weight per gallon, 8.32 volume is 5.12 lbs per gallon or about 0.614 gm/cc. This is measured by standard laboratory procedure.

A further embodiment of the padding fluid would be to use an emulsion with the plastic composition microspheres, ceramic composition microspheres and combinations thereof.

EXAMPLE III

An alternative padding fluid is an emulsion. The preferred emulsion is water in vegetable oil ($H_2O$-disperse-phase-emulsion). An emulsifying agent or surfactant is added to lower the interfacial tension between the oil and the water. The emulsifying agent is selected from the group consisting of triethanolamine-oleate and triethanolamine-stearate, Shou's oil (oxidized vegetable oil), lanolin, lecithin (a non-toxic emulsifier), potassium arabate (from acacia) and Pemulin. The preferred emulsifying agent would be either triethanolamine-oleate, triethanolamine-stearate or Pemulin. If the gel container comes in more intimate contact with the body, lanolin or lecithin should be used.

The emulsion would contain a range of about 65 to 90 volume percent vegetable oil, about 15 to 35 volume percent water and about 5 to 10 percent surfactant or emulsifying agent. The oil is a vegetable oil selected from the group consisting of soybean oil, pine oil, linseed oil, sunflower oil, canola oil, peanut oil and mixtures thereof. It is preferably soybean oil. The water is preferably deionized or distilled. After the oil and water are combined with intermittent agitation, preservatives such as quaternary ammonium compounds like benzalkonium-chloride 0.05 to 1.5 volume percent or Henkel's COVI-OX T-70 in about 0.05 to 1.5 volume percent is added. The mixture is then thickened to the desired viscosity with a thickening agent selected from the group consisting of about 0.4 to 0.5 volume % of Carbopol® EZ-1, and precipitated calcium carbonate of about 0.8 to 1.4 volume percent. This mixture is dispersed well at high shear and then degassed. If Pemulin is used, another thickener may not be needed.

At this point, the plastic microspheres PM 6545 ceramic microspheres (EXTENDOSPHERES CG), or combinations thereof, are added. The percentage volume range of plastic microspheres can be from 0 percent volume to 60 percent volume. The percent volume range of ceramic microspheres can be from 60 percent volume to 0 percent volume. The microspheres lower the density of the mix. If a combination is used, a higher percentage of plastic over ceramic microspheres lowers the density even further. More thickening agents such as precipitated calcium carbonate may be added to reach a desired viscosity. A preferred viscosity is about 1,500,000 cps at 0.5 rpm and about 147,000 cps at 5.0 rpm using a Brookfield model HBT viscometer, TB spindle. The entire mixture is then blended smooth at low shear at low speed. The density of the gel ranges from about 3.5 to 6.5 pounds per gallon depending upon the ratio of plastic to ceramic microspheres.

Another embodiment of the present invention contains an oil in water emulsion with an emulsifying agent selected from the group consisting of Pemulin TR-2 and Carbopol® Ultrez-70.

EXAMPLE IV

The polymeric emulsifier Pemulin TR-2 is a hydrophilically modified polymer. Carbopol® Ultrez-70 can be used when there is great concern for application directly to the skin. Two parts by weight Pemulin TR-2 is added to the vegetable oil phase of 30 parts oil. Seventy parts water are now added to the Pemulin TR-2 and oil. 18% NaOH is added 1 lb base/1 lb Pemulin TR-2 to modify the pH between about 6 and 8, preferably about 7. The stability of the emulsion is then measured. If not stable, then the amount of Pemulin TR-2 is then reduced by reduction of volume percent of Pemulin TR-2 to oil and water. The emulsion is mixed at moderate shear of less than about 1000 rpm; preferably 300–500 rpm to avoid degrading the emulsion. If there is a concern about freezing, add glycerin.

If there is a concern about the growth of microorganisms, gamma radiation is used or methyl and propyl paraben preservative can be used.

The emulsion is then degassed as described hereinbefore. The plastic and/or ceramic microspheres discussed hereinabove are then added in the same ratio as discussed hereinbefore. The emulsion is then mixed at low shear as described hereinbefore.

The density of the gel ranges from about 3.5 to 6.5 pounds/gallon depending upon the ratio of plastic to ceramic microspheres.

Once the gel compositions were found which would meet environmental considerations, it was further found that densities had to be reduced in order to maintain a low weight. Incorporation of ceramic microspheres produced by PQ Corporation under the trademark EXTENDOSPHERES CG CERAMIC MICROSPHERES was of advantageous use in lowering the overall weight. The ceramic microspheres contain up to approximately 5% crystalline silica, mullite and glass and is a non-combustible composition. The ceramic microspheres were chosen over glass because glass shatters easier than ceramic.

Plastic microspheres were also found to be of advantageous use in the gel composition. The plastic microspheres are also produced by PQ Corporation having a business address at 11 Executive Mall, Valley Forge, Pa., and include the model designation PM6545. Such plastic microspheres when dispersed within the gel compositions as hereinbefore described provided for a very low weight cushion 10 while providing increased resiliency, enhanced comfort and deformability even over the ceramic microspheres previously discussed. Also, other prior art spherical particulates are laden with formaldehyde which can leak out and be injurious to the health.

It is believed that the surface area of the plastic microspheres must be of sufficient amount to allow some type of deformation upon force loading and thus aids in the resiliency of the overall system. The flexible plastic microsphere used hereinabove has active air space and, therefore, has an important characteristic of compressibility. This is particularly important when a combination of plastic and rigid ceramic microspheres are used herein. The plastic microspheres give a "bounce effect" of a rigid ceramic ball against a plastic ball. It is a unique effect and increases the comfort level because of the gel response to micro-muscle movement which is superior in the present invention. The ratio can be varied between plastic and ceramic microspheres for a more compressible ratio (plastic) or a more rigid (ceramic) ratio depending on the cushion's use.

When comfort of the user was measured, the approximate weight percentages of the various constituents included approximately 60–80% of padding fluid composition to approximately 20–40% of the microsphere particulates. This was a subjective type of testing wherein users were essentially tested varying compositional weight percentages and it was subjectively determined that the aforementioned weight percentage ratio optimized the comfort level of a majority of users.

The range of the spherical diameters for particulates used ranges between 100 and 400 microns. The resiliency, deformability and comfort did not seem to be affected in this range.

Additional advantages of using the microspheres, whether ceramic or plastic or combinations thereof as hereinbefore described, was the fact that once the microspheres were blended with the gel compositions that such substantially maintained a homogeneity during extended use times. Thus, there was not found to be any congealing or agglomeration of particulates in a particular area of the cushion 10.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases particular locations of elements may be reversed or interposed, all without departing from the spirit or scope of the invention as defined in the appended claims.

What is claimed is:

1. A deformable low density gel composition comprising:

(a) a padding fluid composition having a first predetermined density;

(b) a plurality of particulates dispersed within said padding fluid composition, said particulates being substantially spherical in contour and having a second predetermined density less than said first predetermined density of said padding fluid composition; and (c) said gel composition has about 60–80% by weight of said padding fluid to about 20–40% by weight of said plurality of particulates; and wherein said spherically contoured particulates are a combination of plastic composition microspheres and ceramic composition microspheres which together exhibit a bounce effect.

2. The deformable low density gel composition of claim 1 wherein said density of said gel composition is about 3.5 to 6.5 lbs/gallon.

3. The deformable low density gel composition of claim 1 wherein said plastic microspheres have a diameter of about 100 to 400 microns.

4. A deformable low density gel composition comprising:

(a) a padding fluid composition having a first predetermined density;

(b) a plurality of particulates dispersed within said padding fluid composition, said particulates being substantially spherical in contour and having a second predetermined density less than said first predetermined density of said padding fluid composition; and (c) said gel composition has about 60–80% by weight of said padding fluid to about 20–40% by weight of said plurality of particulates;

wherein said padding fluid composition is selected from the group consisting of vegetable oil, glycerin/water mixture with a thickening agent, water in vegetable oil emulsion and oil and water emulsion.

5. The deformable low density gel composition of claim 4 wherein said padding fluid composition is selected from the group consisting of soybean oil, pine oil, linseed oil and sunflower oil.

6. The deformable low density gel composition of claim 4 wherein said fluid padding composition includes a glycerin/water mixture with a polyacrylic acid thickening agent.

7. The deformable low density gel composition of claim 4 wherein said padding fluid composition is an emulsion selected from the group consisting of soybean oil, linseed oil, pine oil, sunflower oil, canola oil, peanut oil and mixtures thereof with water and a thickening agent.

8. The deformable low density gel composition of claim 7 wherein the thickening agent is selected from the group consisting of a polyacrylic acid thickening agent, and precipitated calcium carbonate.

9. The deformable low density gel composition of claim 4 wherein said padding fluid composition is selected from an emulsion of water with the vegetable oils selected from the group consisting of soybean oil, pine oil, linseed oil, sunflower oil, canola oil, peanut oil and mixtures thereof, with a hydrophilic polymeric emulsifier.

10. A gel filled deformable cushion comprising:

(a) a fluid impervious flexible enclosure forming an internal chamber;

(b) a padding fluid composition within said internal chamber having a first predetermined density;

(c) a plurality of particulates dispersed within said padding fluid composition, said particulates being substantially spherical in contour and having a second predetermined density less than said first predetermined density of said padding fluid composition; and (d) said gel composition has about 60–80% by weight of said padding fluid to about 20–40% by weight of said plurality of particulates; and wherein said spherically contoured particulates are a combination of plastic composition microspheres and ceramic composition microspheres which together exhibit a bounce effect.

11. A gel deformable cushion comprising:

(a) a fluid impervious flexible enclosure forming an internal chamber:

(b) a padding fluid composition within said internal chamber having a first predetermined density;

(c) a plurality of particulates dispersed within said padding fluid composition, said particulates being substantially spherical in contour and having a second predetermined density less than said first predetermined density of said padding fluid composition; and (d) said gel composition has about 60–80% by weight of said padding fluid to about 20–40% by weight of said plurality of particulates; and wherein said spherically contoured particulates are selected from the group consisting of plastic composition microspheres, ceramic composition microspheres and combinations thereof, thereby exhibiting a bounce effect; and wherein the padding fluid composition is selected from the group consisting of vegetable oil, glycerin/water mixture with thickening agent, water in vegetable emulsion and oil and water emulsion.

12. The gel filled deformable cushion of claim 11 wherein said padding fluid composition includes glycerin/water with a polyacrylic acid thickening agent.

13. The deformable load density gel cushion of claim 11 wherein said padding fluid composition is selected from an emulsion of water with the vegetable oils selected from the group consisting of soybean oil, sunflower oil, canola oil, peanut oil and mixtures thereof, with a hydrophilic polymeric emulsifier.

14. A deformable low density gel cushion comprising:

(a) a fluid impervious flexible enclosure forming an internal chamber;

(b) a padding fluid composition within said internal chamber having a first predetermined density;

(c) a plurality of particulates dispersed within said padding fluid composition, said particulates being substantially spherical in contour and having a second predetermined density less than said first predetermined density of said padding fluid composition; and (d) said gel composition has about 60–80% by weight of said padding fluid to about 20–40% by weight of said plurality of particulates wherein said spherically contoured particulates are selected from the group consisting of plastic composition microspheres, ceramic composition microspheres and combinations thereof, thereby exhibiting a bounce effect; and wherein said fluid padding composition is an emulsion selected from the group consisting of soybean oil, sunflower oil, canola oil, peanut oil and mixtures thereof with water and a thickening agent.

15. The deformable low density gel cushion of claim 14 wherein the thickening agent is selected from the group consisting of a polyacrylic acid thickening agent and precipitated calcium carbonate.

16. The deformable low density gel cushion of claim 14 wherein said padding fluid composition is selected from the group consisting of soybean oil, pine oil, linseed oil and sunflower oil.

17. The gel filled deformable cushion of claim 14 wherein said spherically contoured particulates include a spherical diameter of about 100 to 400 microns.

18. The deformable low density gel cushion of claim 11 wherein the density of said gel composition is about 3.5 to 6.5 lbs/gallon.

* * * * *

UNITED STATES PATENT AND TRADEMARK OFFICE

CERTIFICATE OF CORRECTION

PATENT NO. : 5,590,430

DATED : January 7, 1997

INVENTOR(S) : JOEL L. SEREBOFF

It is certified that error appears in the above-indentified patent and that said Letters Patent is hereby corrected as shown below:

Column 4, line 18, "theology" should be --rheology--.

Column 4, line 67, "gm/co" should be --gm/cc--.

Column 6, line 7, "gm/co" should be --gm/cc--.

Column 6, line 15, "fight" should be --tight--.

Column 6, line 39, "aleionized" should be --deionized--.

Claim 11, column 10, line 43, --a-- should be inserted after "with".

Signed and Sealed this

Fourteenth Day of October, 1997

Bruce Lehman

*Attest:*

BRUCE LEHMAN

*Attesting Officer*

*Commissioner of Patents and Trademarks*